US006855219B2

(12) United States Patent
Alilovic et al.

(10) Patent No.: US 6,855,219 B2
(45) Date of Patent: Feb. 15, 2005

(54) METHOD OF GASSING EMULSION EXPLOSIVES AND EXPLOSIVES PRODUCED THEREBY

(75) Inventors: Ivana Alilovic, Corbeil (CA); Earl Reckzin, North Bay (CA)

(73) Assignee: ETI Holdings Corp., North Bay (CA)

( * ) Notice: Subject to any disclaimer, the term of this patent is extended or adjusted under 35 U.S.C. 154(b) by 0 days.

(21) Appl. No.: 10/261,661

(22) Filed: Oct. 2, 2002

(65) Prior Publication Data

US 2004/0065396 A1 Apr. 8, 2004

(51) Int. Cl.[7] ..... D03D 23/00; C06B 31/28
(52) U.S. Cl. ..... 149/109.6; 149/46
(58) Field of Search ..... 149/109.6, 46

(56) References Cited

U.S. PATENT DOCUMENTS 4,305,766 A 12/1981 Edmonds et al.
4,357,184 A 11/1982 Binet et al.
4,664,728 A 5/1987 Cunnion, Jr. et al.
4,708,753 A 11/1987 Forsberg
4,710,248 A 12/1987 Yates et al.
4,828,633 A 5/1989 Forsberg
4,840,687 A 6/1989 Forsberg et al.
4,863,534 A 9/1989 Forsberg
4,919,179 A 4/1990 Chattopadhyay
4,936,931 A 6/1990 Nguyen et al.
4,936,932 A 6/1990 Nguyen
5,401,341 A 3/1995 Forsberg et al.
5,407,500 A 4/1995 Forsberg et al.
5,920,031 A 7/1999 Jahnke
5,936,194 A 8/1999 Marlow et al.
6,022,428 A 2/2000 Cranney et al.
6,027,588 A 2/2000 Vattipalli et al.
6,200,398 B1 * 3/2001 Bush ..... 149/2

* cited by examiner

*Primary Examiner*—Jack Keith
*Assistant Examiner*—Aileen B. Felton
(74) *Attorney, Agent, or Firm*—Philip C. Mendes da Costa Bereskin & Parr

(57) ABSTRACT

The present invention provides a method for producing a gassed explosive composition, comprising the steps of: (a) providing a base explosive composition comprising at least an emulsion explosive composition containing a source of ammonium ions; and, (b) combining the base explosive composition with a gassing solution subsequent to the formation of the emulsion explosive composition, the gassing solution comprising a pH lowering agent. A gassed emulsion explosive composition is also disclosed.

32 Claims, No Drawings

METHOD OF GASSING EMULSION EXPLOSIVES AND EXPLOSIVES PRODUCED THEREBY

FIELD OF THE INVENTION

The present invention relates to gassed explosive compositions, and methods for producing same.

BACKGROUND OF THE INVENTION

A water-in-oil emulsion explosive composition typically comprises a continuous fuel phase, a discontinuous phase (oxidizer solution) that is dispersed within the continuous fuel phase, and an emulsifier (stabilizer). This type of explosive may be mixed with ammonium nitrate (ANFO) to form an "emulsion/ANFO" product, which has a higher energy output per unit mass than the original explosive composition.

An emulsion explosive composition may be reduced in density by the addition of gas or air voids, which materially sensitizes the composition to detonation. Gassing solutions are well known in the art and are used to create gas bubbles in the emulsion. The gassing solution typically contains a material that reacts chemically with the oxidizer solution to produce a fine dispersion of gas bubbles. For example, nitrite ions may be provided in the gassing solution to react with the ammonium ions contained in the discontinuous phase (oxidizer solution) to form nitrogen gas bubbles and water.

One disadvantage of current gassing solutions is the need to ensure that the density of the entire emulsion is suitably decreased, and that there are sufficient 'hot spots' throughout the emulsion to produce a high velocity of detonation. If the gassing solution is not mixed sufficiently, then the explosive may not explode or it may deflagrate. Another disadvantage of current emulsion explosives that utilize a gassing solution is their limited use at low temperatures. At lower temperatures, the gassing solution may not react sufficiently quickly to sensitize the emulsion explosive prior to detonation. Further, at lower temperatures, the gassing solution may itself freeze, thereby negating the effectiveness of the gassing solution.

SUMMARY OF THE INVENTION

The invention relates to the addition of a Lewis Acid to decrease the pH of the gassing solution. Therefore, if the gassing solution utilizes a chemical that reacts at decreased pH to produce a gas, then the addition of the Lewis Acid may either be used to decrease the pH of the gassing solution to a pH at which the reaction will occur, or it may be used to decrease the pH to a level at which the rate of reaction is increased.

In accordance with the instant invention, a gassing solution is utilized that includes a Lewis Acid. The Lewis Acid depresses the freezing point of the gassing solution, thereby enabling the gassing solution to be used at lower operating temperatures without a need for heating of the gassing solution system. For example, the gassing solution may have a freezing point of about −6° C. without a Lewis Acid and about −20° C. with the addition of a Lewis Acid.

It will be appreciated by those skilled in the art that if the gassing solution utilizes a chemical that reacts at decreased pH to produce a gas, then any acid or other compound that reacts in situ in the gassing solution to decrease the pH of the gassing solution (a pH lowering agent) may be utilized.

In accordance with the instant invention, there is provided a method for producing a gassed explosive composition, comprising the steps of:

(a) providing a base explosive composition comprising at least an emulsion explosive composition containing a source of ammonium ions; and, (b) combining the base explosive composition with a gassing solution subsequent to the formation of the emulsion explosive composition, the gassing solution comprising a pH lowering agent.

In one embodiment, the emulsion explosive composition comprises an oxidizer solution containing at least ammonium nitrate in a liquid carrier, the ammonium nitrate being at least one source of ammonium ions, and the oxidizer solution is combined with at least an organic carbonaceous fuel to obtain the emulsion explosive composition wherein the oxidizer solution comprises a discontinuous phase in a continuous fuel phase.

In another embodiment, the method further comprises adding an emulsifier to the emulsion explosive composition prior to the addition of the gassing solution.

In another embodiment, the method further comprises combining an ANFO explosive composition with the emulsion explosive composition wherein the base explosive composition comprises an ANFO/emulsion explosive composition blend.

In another embodiment, the method further comprises producing the ANFO/emulsion explosive composition blend prior to combining the base explosive composition with the gassing solution.

In another embodiment, the gassing solution further comprises a source of ions reactive with ammonium ions to produce a gas.

In another embodiment, the ions reactive with ammonium ions comprise nitrite ions and the gassing solution is prepared by combining a source of nitrite ions and the pH lowering agent with a liquid carrier.

In another embodiment, the pH lowering agent is present in the gassing solution in an amount sufficient to lower the pH of the gassing solution to about 5 or less.

In another embodiment, the gassing solution is prepared by combining sodium nitrite and the pH lowering agent with a liquid carrier.

In another embodiment, the gassing solution comprises sodium nitrite and zinc nitrate in a liquid carrier.

In another embodiment, the pH lowering agent is added to the gassing solution at a rate of from 1 to 90 wt. % based on the weight of the gassing solution.

In another embodiment, the pH lowering agent is added to the gassing solution at a rate of from 15 to 40 wt. % based on the weight of the gassing solution.

In another embodiment, the method further comprises adding the gassing solution to the emulsion explosive composition at a rate of from 0.1 to 1 wt. % based on the weight of the gassed explosive composition.

In another embodiment, the pH lowering agent comprises a Lewis acid. Preferably, the Lewis acid is chosen from the group consisting of ferric nitrate, aluminum nitrate, magnesium nitrate, chromium nitrate, or zinc nitrate and, more preferably, the Lewis acid is zinc nitrate.

In accordance with the instant invention, there is also provided a method for producing an explosive composition comprising:

(a) providing a base explosive composition comprising at least a water-in-oil emulsion explosive composition, the water-in-oil emulsion explosive having a discontinuous aqueous phase containing ammonium ions;

(b) providing a gassing solution containing nitrite ions and a pH lowering agent; and, (c) combining the base explosive composition with the gassing solution subsequent to the formation of the base explosive composition.

In accordance with the instant invention, there is also provided a gassing solution for a base explosive composition comprising at least a water-in-oil emulsion explosive composition which contains ammonium ions in a discrete aqueous phase, the gassing solution comprising at least one source of nitrite ions and at least one Lewis Acid, wherein the at least one Lewis Acid is present in an amount sufficient to lower the pH of the gassing solution to a level at which nitrite ions in the gassing solution are reactive with ammonium ions to form a gas.

In one embodiment, the at least one Lewis Acid is present in an amount sufficient to lower the pH of the gassing solution of about 5 or less.

In another embodiment, the source of nitrite ions comprises sodium nitrite and the at least one Lewis Acid comprises zinc nitrate.

These and other advantages of the instant invention will be more fully and completely understood in conjunction with the following description of the preferred embodiment.

DETAILED DESCRIPTION OF THE INVENTION

According to the instant invention, an emulsion explosive is sensitized by adding a gassing solution to the emulsion explosive. The gassing solution includes at least one chemical that reacts to form a gas. Preferably, the gassing solution includes at least one chemical that reacts with a chemical in the emulsion to form a gas. For example, the gassing solution may include nitrite ions that react with ammonium ions in the emulsion to form nitrogen.

The gassing rate of an emulsion explosive composition depends on a number of factors, including, but not limited to, pH, temperature, concentration of reactants, intensity of mixing, type of emulsifier, stability of the emulsion, and the inclusion of gassing accelerators.

The emulsion explosive composition comprises a water-in-oil emulsion comprising a continuous fuel phase and a discontinuous phase (oxidizer solution). In one embodiment, the emulsion explosive composition may be mixed with a mixture of ammonium nitrate and fuel oil (ANFO) to form an ANFO/emulsion explosive composition blend. The discontinuous phase comprises a source of ammonium ions, preferably ammonium nitrate.

According to one aspect of the instant invention, a chemical reaction that is pH sensitive is used to sensitize the emulsion (i.e. produce a gas to sensitize the emulsion). In accordance with this aspect of the invention, the gas producing reaction proceeds at low pH or, the gas producing reaction proceeds faster at low pH. A pH lowering agent is added to the gassing solution to reduce the pH of the gassing solution to a level at which the gas producing reaction proceeds, or proceeds at a faster rate. The pH lowering agent lowers the pH of the gassing solution prior to being added to a base emulsion explosive composition. Thus, the gassing solution may comprise at least one chemical (preferably a source of nitrite ions) that reacts with at least one chemical in the emulsion (preferably ammonium ions) to form a gas, and a pH lowering agent. In a preferred embodiment, the gassing solution comprises sodium nitrite and zinc nitrate in a liquid carrier.

The pH lowering agent lowers the pH of the gassing solution prior to being added to a base emulsion explosive composition. By adding the pH lowering agent to the gassing solution itself and mixing the solution to evenly distribute the pH lowering agent, it is possible to ensure that all, or essentially all, of the gassing solution is at the selected pH prior to mixing the gassing solution with the emulsion. The pH of the gassing solution subsequent to the addition of the pH lowering agent, but prior to being introduced to the emulsion explosive, is preferably selected based on the target pH of a mixture of a droplet of the gassing solution and a droplet of the water phase of the emulsion explosive composition. Thus, when a droplet of the gassing solution contacts a droplet of the water phase of the emulsion explosive, the pH of the mixture will be at a level at which the gas producing reaction proceeds at the selected rate Preferably, the gassing solution is added to the emulsion explosive at the borehole by pumping the gassing solution (or by using an pressure system) into a stream of emulsion explosive. If the gassing solution freezes or becomes too viscous, then the emulsion explosive could be pumped into a borehole without any or a sufficient amount of the gassing solution mixing with the emulsion explosive. In these circumstances, the explosive will not detonate. Accordingly, in accordance with another aspect of the instant invention, a freezing point reduction agent is added to the gassing solution. Alternately, or in addition, if the gassing solution is used at temperatures at which it may freeze, then a heating system is preferably used to prevent freezing so as to enable the gassing solution to be mixed with the emulsion explosive to a sufficient degree to sensitize the emulsion explosive.

In one aspect of the instant invention, a gassing solution may be provided with both a pH reduction agent and a freezing point reduction agent. Preferably, the pH reduction agent and the freezing point reduction agent are the same agent.

The gassing solution produces one or more of the following effects:

(a) accelerates the rate of chemical reaction between ammonium ions and the nitrite ions;

(b) accelerates the gassing rate at lower temperatures;

(c) increases the stability of the gassed explosive composition; and (d) lowers the freezing point of the gassing solution so that the emulsion explosive sensitization may be used in cold temperatures.

Preferably, the pH lowering agent comprises a Lewis acid. More preferably the pH lowering agent comprises a compound chosen from the group consisting of ferric nitrate, aluminum nitrate, magnesium nitrate, chromium nitrate or zinc nitrate. Most preferably the pH lowering agent comprises zinc nitrate The pH lowering agent is present in the gassing solution in an amount sufficient to lower the pH of the gassing solution to a level at which the gassing reaction proceeds at a selected rate. For example, if the gassing solution includes a source of nitrite ions to react with ammonium ions in the emulsion explosive, then preferably, the pH lowering agent is present in the gassing solution in an amount sufficient to lower the pH of the gassing solution to about 6 or less, more preferably about 5 or less, and most preferably about 4 or less. It will be appreciated that the actual pH level that is chosen will depend upon the reaction kinetics of the gas producing reaction that is utilized to sensitize the emulsion explosive.

In a preferred embodiment, the pH lowering agent is added to the gassing solution at a rate of from 1 to 90 wt % based on the weight of the gassing solution, more preferably at a rate of from 15 to 40 wt % based on the weight of the gassing solution, and most preferably at a rate of from 20 to 30 wt % based on the weight of the gassing solution.

In a preferred embodiment, the gassed explosive emulsion comprises from about 0.1 to about 1 and preferably from about 0.4 to about 0.6 wt % of the gassing solution based on the weight of the gassed explosive composition.

The emulsion explosive may be any water-in-oil emulsion explosive known in the art. The emulsion explosive may be mixed with an ANFO explosive to produce an emulsion/ANFO blend explosive composition. As used herein, the term base explosive composition is used to refer to the explosive composition with which the gassing solution is mixed and used.

Oils and aqueous inorganic oxidizing salt solutions known to the explosive emulsion art may be employed in the emulsion explosive, e.g., oils and salt solutions disclosed in U.S. Pat. No. 4,287,010, the disclosure of which patent is incorporated herein by reference. Most often, the inorganic oxidizing salt present in the emulsion's aqueous phase will be an ammonium, alkali metal, or alkaline-earth metal nitrate or perchlorate, preferably ammonium nitrate, alone or in combination with, for example, up to about 50 percent sodium nitrate or calcium nitrate (based on the total weight of inorganic oxidizing salts in the aqueous phase). Salts having monovalent cations are preferred if the emulsifying agent used is a combination of a fatty acid salt and a fatty acid, as is explained in the aforementioned U.S. Pat. No. 4,287,010. Suitable oils for use in the carbonaceous fuel include fuel oils and lube oils of heavy aromatic, naphthenic, or paraffinic stock, mineral oil, dewaxed oil, etc.

Typically, the aqueous phase, or discontinuous phase, may make up to 90% v/v of the emulsion explosive composition. The aqueous phase may be prepared from a melt of one or more nitrates (e.g. ammonium nitrate, sodium nitrate and calcium nitrate) with water to lower the melting point.

The oil content of the emulsion may be sufficient to provide a substantially oxygen-balanced emulsion, or it may contain excess oil (and be oxidizer-deficient), if it is to be blended with fuel-deficient or fuel-free solid particulate inorganic oxidizing salt. The benefits that may be derived from using such a "high oil" emulsion are described in the aforementioned U.S. Pat. No. 4,555,278, the disclosure of which is incorporated herein by reference.

The emulsion explosive may also include other common industry additives. For example, chemical sensitizers may be added to the emulsion, e.g., in solution in the discontinuous aqueous phase thereof or as a dispersion of a finely divided solid therein. In addition, one or more detonation catalysts such as sodium perchlorate, ammonium dichromate, etc. also may be present, either in the emulsion or in the particulate solid portion of the blend.

Further, one or more surfactant may also be added to the aqueous phase.

If the base emulsion includes an ANFO explosive, then the organic carbonaceous fuel for the ANFO explosive may be selected from any fuel known in the art. The fuel may be a solid (e.g. a wax) or a liquid (e.g. fuel oil, heating oil, diesel fuel, jet fuel, kerosene, mineral oils, saturated fatty acids such as lauric acid and stearic acid, alcohols such as cetyl alcohol, corn oil, soy bean oil and the like) or a mixture of solid and liquid fuels. Such fuels may also be supplemented with fuel-soluble ingredients such as glucose, mannose, fructose, waxes, such as microcrystalline wax, paraffin wax, petroleum wax and the like. Preferably, the organic carbonaceous fuel comprises fuel oil, such as No. 2 fuel oil.

The inorganic oxidizing salt for the ANFO explosive may comprise ammonium nitrate. The ammonium nitrate is in the form of separate discrete particles, such as prills, granules, pellets and/or fines. Particulate ammonium nitrate suitable in ANFO blasting explosive compositions are known in the art.

A portion of the ammonium nitrate component may be replaced by other inorganic oxidizer salts known in the art including alkali metal nitrates (such as sodium nitrate and potassium nitrate) and perchlorates or alkaline-earth metal nitrates (such as calcium nitrate, mangnesium nitrate and barium nitrate) and perchlorates. These additional components may be added in an amount from about 0 to about 20 wt %, and more preferably from 0 to about 15 wt % based upon the weight of the ammonium nitrate particles.

It is preferred that the organic carbonaceous fuel is present in an amount from about 2 to about 10 wt % based upon the weight of the carbonaceous fuel and inorganic oxidizing salts. More preferably, the organic carbonaceous fuel is present in an amount from about 4 to about 8 wt % and, most preferably, the ratio of inorganic oxidizing salts to carbonaceous fuel is about 94:6.

The explosive composition of the present invention contains sufficient organic carbonaceous fuel so that the explosive composition is essentially oxygen balanced, taking into consideration the total oxidizing salts, fuel, sensitizers and other additives present in the explosive. Preferably, the blend has an oxygen balance more positive than about −25% and, more preferably, in the range of about −10% to about +10%.

In one aspect, the present invention provides for a method for producing an explosive composition, comprising the steps of:

(a) providing a base explosive composition comprising at least a water-in-oil emulsion explosive composition, the water-in-oil emulsion explosive having a discontinuous aqueous phase containing ammonium ions;

(b) providing a gassing solution containing nitrite ions and a pH lowering agent; and, (c) combining the base explosive composition with the gassing solution subsequent to the formation of the base explosive composition.

The emulsion explosives are preferably prepared by mixing the discontinuous phase (oxidizer phase) with the continuous phase (fuel phase), under emulsifying conditions. Surface tension modifying agents (emulsifiers) are preferably added to promote the subdivision of the droplets of the oxidizer phase and the dispersion of the continuous phase. The emulsifiers also have a stabilizing effect on the emulsion preventing phase separation and crystallization of the dispersed phase.

The discontinuous phase may comprise from about 50 to about 95%, preferably 80 to 95% by weight of the total weight of the emulsion explosive composition. The continuous phase (containing oil or oil and wax) preferably comprises from 2 to 10%, preferably from 3 to 8% by weight of the total weight of the explosive composition. The emulsifier is preferably added in a range of 0.5 to 3%, and preferably 1 to 2% by weight of the total weight of the emulsion composition.

The emulsion explosive preferably contains a sensitizing component distributed throughout the composition, and which may comprise of hollow glass or plastic microspheres or gas generating agent.

Additional additives may be incorporated in the emulsion explosive composition in order to improve the sensitivity, strength, rheology and cost of the final product.

The methods of incorporating a gas generating component (chemical generation of gas in-situ) are well known in the art. The chemical gassing agent comprising (e.g. sodium nitrite in aqueous solution and suitable water soluble additives to increase rate of reaction) are blended into the emulsion. As soon as blending is initiated, sodium nitrite ions start to react with ammonium ions to produce nitrogen gas.

The amount of gassing solution used will depend on the proportion or number of gas bubbles required, i.e. on the density requirement for the emulsion explosive.

Typically, the gassing solution is dispersed in the emulsion or emulsion/ANFO blend by subjecting the gassing solution and emulsion or emulsion/ANFO blend to mixing or mixing and shear. Any mixing device that provides the degree of mixing can be used, such as a pump and static mixer arrangement, or orifice plate. The gassed emulsion can be cartridged or fed through a loading hose into a borehole. Further, after final placement of the explosive into a borehole or package, gassing should progress to completion in a desired time frame, for example, before borehole stemming.

It will be appreciated that this method could be used with systems that use reactions other than a reaction between ammonium and nitrite ions as a gas producing reaction.

In a preferred embodiment, an emulsifier is added to the emulsion explosive prior to the addition of the gassing solution. In a preferred embodiment, an ANFO explosive composition is combined with the emulsion explosive composition prior to combining the base explosive composition with the gassing solution.

The gassing solution is prepared by combining the source of nitrite ions, preferably sodium nitrite, with the pH lowering agent in a liquid carrier.

The invention will be further understood by the following examples that are not to be construed as a limitation on the invention. Those skilled in the art will appreciate the other and further embodiments are obvious and within the spirit and scope of this invention from the teachings of the present examples taken with the accompanying specification.

EXAMPLE 1

The gassing reaction times for gassed explosive compositions prepared in accordance with the present invention were compared with gassed explosive compositions not containing the pH lowering agents described herein. The different explosive compositions that were prepared are set out in Table 1 below.

In the described tests set out in Table 1, the gassed emulsion was prepared by mixing together the base emulsion or emulsion/ANFO blend and 0.5% by weight of the gassing solution using an air-driven stirrer. The gassing rate of the emulsions prepared were determined at different temperatures by measuring the density change over time at atmospheric pressure.

| | Emulsion Explosive Composition | | | | | | | | |
|---|---|---|---|---|---|---|---|---|---|
| Run # | Ammonium Nitrate | Calcium Nitrate | Sodium Nitrate | Urea | Water | Diesel Oil | Mineral Oil | Emulsifier (SMO) | Emulsif PIBSA based |
| 1 | 76.3 | — | — | — | 16.925 | 5.2 | — | 1.4 | — |
| 2 | 76.24 | — | — | — | 16.86 | 5.2 | — | 1.4 | — |
| 3 | 82.83 | — | — | — | 10.50 | 5.48 | — | 0.89 | — |
| 4 | 82.83 | — | — | — | 10.625 | 5.48 | — | 0.89 | — |
| 5 | 82.82 | — | — | — | 10.51 | 5.48 | — | 0.89 | — |
| 6 | 82.83 | — | — | — | 10.625 | 5.48 | — | 0.89 | — |
| 7 | 82.82 | — | — | — | 10.51 | 5.48 | — | 0.89 | — |
| 8 | 67.24 | 12.02 | — | — | 15.84 | — | 5.2 | 1.4 | — |
| 9 | 67.24 | 12.02 | — | — | 15.84 | — | 5.2 | 1.4 | — |
| 10 | 74.67 | — | 8.06 | — | 10.50 | — | 5.2 | — | 1.4 |
| 11 | 71.05 | 10.56 | — | 1.02 | 10.7 | — | 5.48 | 0.89 | — |
| 12 | 82.83 | — | — | — | 10.50 | 5.48 | — | — | 0.89 |

| | Gassing Solution Composition | | | | Reaction | Results | |
|---|---|---|---|---|---|---|---|
| Run # | Citric Acid | Acetic Acid | Sodium Nitrate | Zinc Nitrate | Condition Temp. ° C. | Final Density (g/cc) | Time (min) |
| 1 | 0.10 | — | 0.075 | — | +20 | 1.02 | 360 |
| 2 | 0.10 | — | 0.075 | 0.125 | +20 | 1.02 | 20 |
| 3 | 0.10 | — | 0.075 | 0.125 | +18 | 1.05 | 30 |
| 4 | 0.10 | — | 0.075 | — | +18 | 1.05 | 480. |
| 5 | 0.10 | — | 0.075 | 0.125 | +28 | 1.05 | 10 |
| 6 | 0.10 | — | 0.075 | — | +28 | 1.05 | 360. |
| 7 | 0.10 | — | 0.075 | 0.125 | +40 | 1.05 | 3 |
| 8 | 0.10 | — | 0.075 | 0.125 | +20 | 1.05 | 25 |
| 9 | 0.10 | — | 0.075 | — | +20 | 1.05 | 480 |
| 10 | — | 0.1 | 0.075 | 0.125 | +30 | 1.05 | 9 |
| 11 | 0.1 | — | 0.075 | 0.125 | +20 | 1.05 | 20 |
| 12 | 0.1 | — | 0.075 | 0.125 | +18 | 1.02 | 22 |

As can be seen, the gassed explosive compositions prepared according to the present invention (i.e. Runs 2, 3, 5, 7, 8, 10, 11, 12) showed a significant reduction in gassing reaction times compared with the explosive compositions not containing zinc nitrate (i.e. Runs 1, 4, 6, 9).

Run 2 which contained zinc nitrate was approximately 18 times faster than Run 1 which did not contain zinc nitrate at +20° C. Similarly, Run 5 which contained zinc nitrate was approximately 36 times faster than Run 6 which did not contain zinc nitrate at +28° C.

EXAMPLE 2

The freezing points for the gassing solution prepared in accordance with the present invention were compared with the gassing solutions not containing the pH lowering agents described herein. The freezing point for a gassing solution comprising 15 w/w % sodium nitrite and 15 w/w % zinc nitrate is approximately −20° C. In comparison, the freezing point for a gassing solution comprising 15 w/w % sodium nitrite without any zinc nitrate is approximately −6° C. Therefore, the inclusion of zinc nitrate in the gassing solution significantly lowers the freezing point of the gassing solution, and allows for easy handling of the gassing solution in cold climates without the need for heating of the gassing solution.

What is claimed is:

1. A method for producing a gassed explosive composition, comprising the steps of:

a) providing a base explosive composition comprising at least an emulsion explosive composition containing a source of ammonium ions; and, b) combining the base explosive composition with a gassing solution subsequent to the formation of the emulsion explosive composition, the gassing solution comprising at least one Lewis Acid.

2. The method of claim 1, wherein the emulsion explosive composition comprises an oxidizer solution containing at least ammonium nitrate in a liquid carrier, the ammonium nitrate being at least one source of ammonium ions, and the oxidizer solution is combined with at least an organic carbonaceous fuel to obtain the emulsion explosive composition wherein the oxidizer solution comprises a discontinuous phase in a continuous fuel phase.

3. The method of claim 1, further comprising combining a ANFO explosive composition with the emulsion explosive composition wherein the base explosive composition comprises an ANFO/emulsion explosive composition blend.

4. The method as claimed in claim 3, further comprising adding an emulsifier to the emulsion explosive composition prior to the addition of the gassing solution.

5. The method as claimed in claim 3, further comprising producing the ANFO/emulsion explosive composition blend prior to combining the base explosive composition with the gassing solution.

6. The method as claimed in claim 1, wherein the gassing solution further comprises a source of ions reactive with ammonium ions to produce a gas.

7. The method as claimed in claim 6 wherein the ions reactive with ammonium ions comprise nitrite ions and the gassing solution is prepared by combining a source of nitrite ions and the at least one Lewis Acid with a liquid carrier.

8. The method as claimed in claim 7, wherein the at least one Lewis Acid is present in the gassing solution in an amount sufficient to lower the pH of the gassing solution to a level at which nitrite ions in the gassing solution are reactive with ammonium ions in the base explosive composition to form a gas.

9. The method as claimed in claim 7, wherein the at least one Lewis Acid is present in the gassing solution in an amount sufficient to lower the pH of the gassing solution to about 5 or less.

10. The method as claimed in claim 1, wherein the gassing solution is prepared by combining sodium nitrite and the at least one Lewis Acid with a liquid carrier.

11. The method as claimed in claim 1, wherein the gassing solution comprises sodium nitrite and zinc nitrate in a liquid carrier.

12. The method as claimed in claim 1, wherein the at least one Lewis Acid is added to the gassing solution at a rate of from 1 to 90 wt. % based on the weight of the gassing solution.

13. The method as claimed in claim 1, wherein the at least one Lewis Acid is added to the gassing solution at a rate of from 15 to 40 wt. % based on the weight of the gassing solution.

14. The method as claimed in claim 13, further comprising adding the gassing solution to the emulsion explosive composition at a rate of from 0.1 to 1 wt. % based on the weight of the gassed explosive composition.

15. A method for producing an explosive composition comprising:

a) providing a base explosive composition comprising at least a water-in-oil emulsion explosive composition, the water-in-oil emulsion explosive having a discontinuous aqueous phase containing ammonium ions;

b) providing a gassing solution containing nitrite ions and at least one Lewis Acid; and, c) combining the base explosive composition with the gassing solution subsequent to the formation of the base explosive composition.

16. The method as claimed in claim 15, wherein the at least one Lewis Acid is present in the gassing solution in an amount sufficient to lower the pH of the gassing solution to a level at which nitrite ions in the gassing solution are reactive with ammonium ions in the base explosive composition to form a gas.

17. The method as claimed in claim 15, wherein the at least one Lewis Acid is present in the gassing solution in an amount sufficient to lower the pH of the gassing solution to about 5 or less.

18. The method as claimed in claim 15, wherein the gassing solution comprises sodium nitrite and zinc nitrate in a liquid carrier.

19. The method as claimed in claim 15 wherein the at least one Lewis Acid is added to the gassing solution at a rate of from 1 to 90 wt. % based on the weight of the gassing solution.

20. The method as claimed in claim 15, wherein the at least one Lewis Acid is added to the gassing solution at a rate of from 15 to 40 wt. % based on the weight of the gassing solution.

21. The method as claimed in claim 20, further comprising adding the gassing solution to the emulsion explosive composition at a rate of from 0.1 to 1 wt. % based on the weight of the gassed explosive composition.

22. A gassing solution for a base explosive composition comprising at least a water-in-oil emulsion explosive composition which contains ammonium ions in a discrete aqueous phase, the gassing solution comprising at least one source of nitrite ions and at least one Lewis Acid, wherein the at least one Lewis Acid is present in an amount sufficient to lower the pH of the gassing solution to a level at which nitrite ions in the gassing solution are reactive with ammonium ions to form a sufficient amount of gas to form a sensitized explosive composition.

23. The gassing solution as claimed in claim 22, the at least one Lewis Acid is present in an amount sufficient to lower the pH of the gassing solution of about 5 or less.

24. The gassing solution as claimed in claim 22, wherein the source of nitrite ions comprises sodium nitrite and the at least one Lewis Acid comprises zinc nitrate.

25. The gassing solution as claimed in claim 22, wherein the at least one Lewis Acid comprises from 1 to 90 wt. % of the gassing solution based on the weight of the gassing solution.

26. The gassing solution as claimed in claim 22, wherein the at least one Lewis Acid comprises from 15 to 40 wt. % of the gassing solution based on the weight of the gassing solution.

27. The method as claimed in claim 1, wherein the at least one Lewis acid is chosen from the group consisting of ferric nitrate, aluminum nitrate, magnesium nitrate, chromium nitrate, or zinc nitrate.

28. The method as claimed in claim 27, wherein the at least one Lewis acid is zinc nitrate.

29. The method as claimed in claim 15, wherein the at least one Lewis acid is chosen from the group consisting of ferric nitrate, aluminum nitrate, magnesium nitrate, chromium nitrate, or zinc nitrate.

30. The method as claimed in claim 29, wherein the at least one Lewis acid is zinc nitrate.

31. The gassing solution as claimed in claim 22, wherein the at least on Lewis acid is chosen from the group consisting of ferric nitrate, aluminum nitrate, magnesium nitrate, chromium nitrate, or zinc nitrate.

32. The gassing solution as claimed in claim 22, wherein the at least on Lewis acid is zinc nitrate.

* * * * *